US007364827B2

(12) United States Patent
Ueda et al.

(10) Patent No.: US 7,364,827 B2
(45) Date of Patent: Apr. 29, 2008

(54) ELECTROPHOTOGRAPHIC TONER

(75) Inventors: Takamasa Ueda, Hachioji (JP); Kazuya Isobe, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 301 days.

(21) Appl. No.: 11/298,725

(22) Filed: Dec. 8, 2005

(65) Prior Publication Data

US 2006/0172211 A1 Aug. 3, 2006

(30) Foreign Application Priority Data

Feb. 3, 2005 (JP) ..... 2005-027412

(51) Int. Cl.
*G03G 9/08* (2006.01)

(52) U.S. Cl. ..... 430/108.4; 430/108.1; 430/108.8; 430/109.3; 430/111.4

(58) Field of Classification Search ..... 430/108.4, 430/108.8, 109.1, 108.1, 109.3
See application file for complete search history.

(56) References Cited

U.S. PATENT DOCUMENTS

2003/0134216 A1 7/2003 Kawanishi et al.
2003/0190537 A1* 10/2003 Nakamura et al. ..... 430/108.4
2004/0043318 A1* 3/2004 Sato et al. ..... 430/108.4
2004/0058259 A1 3/2004 Kobayashi et al.
2004/0152003 A1* 8/2004 Sato et al. ..... 430/108.4
2004/0175640 A1* 9/2004 Kawanishi et al. ..... 430/108.8
2004/0224246 A1* 11/2004 Sato et al. ..... 430/108.8
2005/0287461 A1* 12/2005 Sweeney et al. ..... 430/108.8

FOREIGN PATENT DOCUMENTS

EP 0 736 812 10/1996
JP 2002-221825 9/2002

OTHER PUBLICATIONS

European Search Report for 05257649.3, mailed Jun. 7, 2006, 6 pgs.
European Search Report for 05257649.3, mailed Jun. 7, 2006, 6 pgs.

* cited by examiner

*Primary Examiner*—Christopher RoDee
(74) *Attorney, Agent, or Firm*—Squire, Sanders & Dempsey L.L.P.

(57) ABSTRACT

An electrophotographic toner comprising a resin, a colorant and a release agent which comprises a first wax and a second wax, wherein: (i) the first wax exhibits: an endothermic peak appearing in the range 75-100° C., a peak width at half height of the endothermic peak of 10-40° C., an exothermic peak appearing in the range 70-100° C. and a peak width at half height of the exothermic peak of 10-40° C., in a DSC measurement; (ii) the second wax exhibits: an endothermic peak appearing in the range 60-90° C., a peak width at half height of the endothermic peak of 5° C. or less, an exothermic peak appearing in the range 55-80° C. and a peak width at half height of the exothermic peak of 5° C. or less, in the DSC measurement; (iii) a weight ratio of the first wax to the second wax is between 9:1 and 2:8; and (iv) the resin contains a polar group.

17 Claims, 1 Drawing Sheet

ELECTROPHOTOGRAPHIC TONER

FIELD OF THE INVENTION

The present invention relates to an electrophotographic toner.

BACKGROUND OF THE INVENTION

In recent years, the number of full-color images is increasing in the field of electrophotography. In full-color images, an image is formed of a larger number of pixels compared to text images. Therefore, images have a tendency to have more regions of so-called solid image. Since a larger amount of toner passes through the fixing apparatus while fixing an image having such solid regions, generally silicone oil has been utilized to prevent offset when a fixing apparatus having a contact member is used. Although offset is reduced by employing silicone oil, silicone oil may remain on the image surface to cause glare or difficulty in additional writing on the image. Further, when silicone oil remains unevenly on the image surface, the image quality may be deteriorated due to the unevenness of the image.

To overcome this problem, a release agent, typically a wax, is added to the toner making silicone oil unnecessary when the image is fixed. Namely, an oil-less fixing method has been employed these days. However, even in this method, unevenness in gloss tends to occur due to the wax incorporated in the toner, resulting in degradation of image quality. This becomes problematic when using a fixing apparatus having a transport device which incorporates a contact member.

However, since a transport device employing a contact member is a simple and efficient transport means, it is rather difficult to be replaced with other methods. Accordingly, at present, a method to provide stable images using a full-color image formation method has not been fully established. On the other hand, with respect to a low-temperature fixing toner, a lower melting point resin or a lower softening point resin used for the low-temperature fixing toner often causes problems. However, disclosed have been methods to improve the low-temperature fixing toner in terms of selection of a wax used as a release agent (for example, refer to Patent Document 1).

Further, solution of the above-described problem has become more important for a so-called polymerized toner than for a pulverized toner, because, even for the polymerized toner which has recently been widely employed, oil-less fixing is becoming a main current as a fixing method, since addition of a release agent in the production process is easier for the polymerized toner. In the polymerized toner, a resin having a polar group is used for the reason of the production method. Accordingly, improvement in stability of electrostatic chargeability of the toner is desired, since the polar group has a hygroscopic nature.

Also, in view of a desire to conservation of resources and energy, a fixing process, which consumes the largest energy among electrophotographic processes, is expected to carry out at lower temperature and in a simple operation. In this point of view, the above-described oil-less fixing method and the transport method using a transport device having a contact member are advantageous for a low temperature and simple operation. Improvement in electrostatic chargeability, avoidance of image unevenness as well as releasability of the toner is expected.

SUMMARY OF THE INVENTION

An object of the present invention is to provide an electrophotographic toner capable of exhibiting at least one of a low temperature fixing property, excellent releasability and in electrostatic chargeability, and enables forming an electrophotographic image free from unevenness even when oil is not used, while using a contact type fixing device having a member which becomes in touch with the image while the image is being-discharged from the printer after fixing.

One of the aspects of the present invention is an electrophotographic toner comprising a resin, a colorant and a release agent which comprises a first wax and a second wax, wherein: (i) the first wax exhibits: an endothermic peak appearing in the range 75-100° C., a peak width at half height of the endothermic peak of 10-40° C., an exothermic peak appearing in the range 70-100° C. and a peak width at half height of the exothermic peak of 10-40° C., in a DSC measurement; (ii) the second wax exhibits an endothermic peak appearing in the range 60-90° C., a peak width at half height of the endothermic peak of 5° C. or less, an exothermic peak appearing in the range 55-80° C. and a peak width at half height of the exothermic peak of 5° C. or less, in the DSC measurement; (iii) a weight ratio of the first wax to the second wax is between 9:1 and 2:8; and (iv) the resin contains a polar group.

DETAIL DESCRIPTION OF THE PREFERRED EMBODIMENTS

Figure 1:
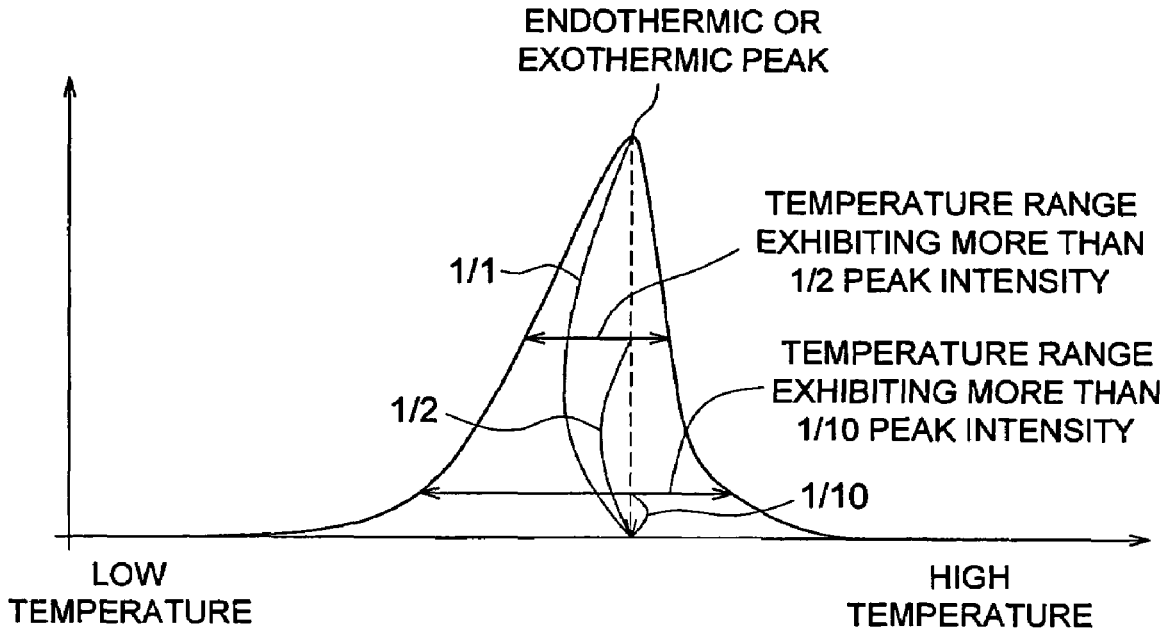
FIG. 1 illustrates a typical example of a DSC chart.

The present invention will now be detailed.

It has been confirmed in the present invention that selection of wax is important to obtain images free from unevenness and to obtain stable electrostatic chargeability of the toner. A low melting point wax is advantageous for low temperature fixing. However, merely lowering the melting point of a toner results in deterioration of the property of a toner. This is assumed to be because, a low melting point wax tends to melt with frictional heat and the external additive may be buried in the melted wax. This problem has been overcome by broadening the melting point of a wax (which means broadening a peak width of the wax in DSC measurement), namely, anti-friction (hardness of the wax) and lowering the melting point of the wax have been simultaneously attained. On the other hand, use of an appropriate amount of a sharp melting point wax is effective to improve releasability of the toner, whereby wax is instantaneously supplied on the surface of toner particles to further improve the releasability and to reduce unevenness of the images. Thus, a higher releasability and reduction of unevenness of the image are simultaneously attained.

Herein, the broad melting point wax (which correspond to the first wax in the above Item (1)) to be used as a release agent represents a was exhibiting: an endothermic peak appearing in the range 75-100° C., a peak width at half height of the endothermic peak of 10-40° C., an exothermic peak appearing in the range 70-100° C. and a peak width at half height of the exothermic peak of 10-40° C., in a DSC measurement, and the sharp melting point wax (which correspond to the second wax in the above Item (1)) to be also used as a release agent represents a wax exhibiting: an endothermic peak appearing in the range 60-90° C., a peak width at half height of the endothermic peak of 5° C. or less, an exothermic peak appearing in the range 55-80° C. and a peak width at half height of the exothermic peak of 5° C. or less, in the DSC measurement.

In order to attain low temperature fixing while using a small diameter wax, the melting point of a wax to be used for the toner is preferably lower, and the domain size of the wax in the toner is preferably smaller than usual (usual domain size of the wax is around 1 μm).

The above-mentioned method for reducing unevenness in the image is effectively utilized for a contact type fixing device having a member which becomes in touch with the image (also referred to as a contact member) while the image is being transported through the printer after fixing. The area in an image in touch with the contact member while the image is being fixed is easily cooled down, while the area not in touch with the contact member is not cooled. Accordingly, difference in crystallization state or in existing state of the wax between the areas in touch with and not in touch with the contact member may occur on the surface of the fixed image. This difference in the crystallization state or in the existing state of the wax may cause difference in glossiness of the image resulting in forming unevenness in the image.

In the present invention, unevenness of an image was improved by improving the thermal behavior of the wax while cooling. Specifically, attention has been paid to the crystallization behavior of the wax in the image being fixed, namely, the crystallization of the wax while cooling was slowed down by controlling the thermal behavior of the wax, so that the re-crystallization process of the wax was broadened. As a result, the difference in the crystallization states of the wax at the area in touch with the contact member and at the area not in touch with the contact member has become smaller, resulting in decreasing the unevenness of the image. On the other hand, by adding an appropriate amount of sharp melting point wax to the above mentioned broad melting point wax, the improvement in releasability of the toner was attained, whereby wax was instantaneously supplied on the surface of each toner particle to further improve the releasability and to reduce unevenness of the images. Thus, a higher releasability and reduction of unevenness of the image have been simultaneously attained.

The broad melting point wax preferably exhibits an endothermic peak appearing in the range 75-100° C. When the lower end of the above range becomes lower than 75° C., problems may occur in storage property of the toner and in anti-blocking property of the toner (developer)-when a large number of printing is carried out. Alternatively, when the upper end of the above peak appearing range exceeds 100° C., problems may occur in releasability of the image. The broad melting point wax preferably exhibits an exothermic peak appearing in the range 70-100° C. When the lower end of the above range becomes lower than 70° C., problems may occur in storage property of the toner and in anti-blocking property of the toner when a large number of printing is carried out. Alternatively, when the upper end of the above peak appearing range exceeds 100° C., problems may occur in releasability of the image. The peak widths at half height of the endothermic peal and of the exothermic peak are both preferably in the range 10-40° C., and when the widths exceed 40° C., the amount of wax necessary for releasing the image becomes short. Further, the peak widths at 1/10 height of the endothermic peal and of the exothermic peal are both preferably in the range 20-50° C., and when the widths exceed 50° C., a variety of crystallizing states of the wax may exist in the image after cooled and a convexo-concave surface may be formed in the image, resulting in reduction of glossiness of the image.

The sharp melting point wax preferably exhibits an endothermic peak appearing in the range 60-90° C. When the lower end of the above range becomes lower than 60° C., problems may occur in storage property of the toner and in anti-blocking property of the toner when a large number of printing is carried out. Alternatively, when the upper end of the above peak appearing range exceeds 90° C., problems may occur in releasability of the image. The sharp melting point wax preferably exhibits an exothermic peak appearing in the range 55-80° C. When the lower end of the above range becomes lower than 55° C., problems may occur in storage property of the toner and in anti-blocking property of the toner when a large number of printing is carried out. Alternatively, when the upper end of the above peak appearing range exceeds 80° C., problems may occur in releasability of the image. The peak widths at half height of the endothermic peal and of the exothermic peak are both preferably 5° C. or less and more preferably 0-5° C., and when the widths exceed 5° C., the amount of wax necessary for releasing the image becomes short. Further, the peak widths at 1/10 height of the endothermic peak and of the exothermic peak are both preferably 10° C. or less and more preferably 0-10° C., and when the widths exceed 10° C., the releasability of the image may be degraded since too much wax may exist on the surface of each toner particle.

With respect to the broad melting point wax, the number average molecular weight is preferably 300-1,000 and more preferably 400-800. The Mw/Mn value is preferably 1.01-1.20. The reason why a low molecular weight wax exhibits a broadened re-crystallization process is not fully clear, however, it is assumed that the melting rate of a low molecular weight wax is rather fast and a small distribution in the molecular weight of the wax may cause a larger distribution in re-crystallization temperature, resulting in the broadened thermal behavior.

With respect to the sharp melting point wax, the number average molecular weight is preferably 300-1,500 and more preferably 400-1,200. The Mw/Mn value is preferably 1.01-1.20.

It is preferable in the present invention that the microcrystalline wax the property of which is described in the above Item (1) is used as a broad melting point wax and the sharp melting point wax the property of which is also described in the above Item (1) is used in combination with the microcrystalline wax. The preferable weight ratio of the broad melting point wax to the sharp melting point wax is between 9:1 and 2:8.

The micro-crystals of microcrystalline wax, which is the characteristics of the microcrystalline wax, are assumed to exist forming small domains even in the toner, accordingly, the microcrystalline wax easily melts with a small amount of heat in the toner production process. When the microcrystalline wax is used in combination with a resin having a polar group, which is incompatible with the microcrystalline wax, the melted microcrystalline wax tends to come out to the surface of the toner, whereby the surface of the toner particle becomes hydrophobic and the effect of moisture is reduced. Thus, the toner stable in electrostatic chargeability is obtained. When the sharp melting point wax is also used in the toner, this wax also tends to come out to the surface of the toner in the production process of the toner and make the toner surface more hydrophobic, whereby the effect of moisture is further reduced, which also contributes to obtain stable electrostatic chargeability.

The thermal behavior of the wax is evaluated using a differential scanning calorimeter (DSC). Specific examples of a DSC include: DSC-7 produced by Perkin Elmer, Inc. and DSC-200 produced by Seiko Instruments Inc. In the specific method for evaluation by DSC, as a temperature rising/cooling condition, after leaving at 0° C. for one minute, the temperature is raised to 200° C. under a constant temperature raising rate, and the observed largest peak is the endothermic peak. Thereafter, after leaving at 200° C. for one minute, the temperature is decreased under a constant temperature decreasing rate, and the observed largest peak is the exothermic peak. The peak width at half height of the endothermic or exothermic peak was obtained as follows:

(i) obtaining a intersection point of a vertical line in the DSC chart including the peak point in the (endothermic or exothermic) peak profile and a tangential line of the base line;

(ii) obtaining the ½ height point in the line drawn between the peak point and the intersection point described in (i);

(iii) drawing a line parallel to the tangential line of the base line including the ½ height point described in (ii);

(iv) obtaining two intersection points of the line parallel to the tangential line of the base line described in (iii) and the peak profile curves in the higher temperature side and the lower temperature side;

(v) the peak width at half height of a peak is the temperature difference between the two temperatures corresponding to the two intersection points described in (iv).

The peak width at 1/10 height of a peak was determined in the same manner as above except that a line parallel to the tangential line of the base line was drawn including the 1/10 height point from the tangential line of the base line. A DSC chart was shown in FIG. 1.

In this invention, the thermal behavior of the wax was evaluated as follows.

(Melting Point, Crystallization Temperature)

A differential scanning calorimeter (DSC-200, produced by Seiko Instruments Inc.) was used to determine the melting point and the crystallization temperature of a toner. In each measurement, 10 mg of a sample to be measured was precisely weighed and charged into an aluminum pan, also alumina was charged in another aluminum pan and used as a reference. The each samples were kept under at 0° C. for one minute. After that, the temperature was to 200° C. at a raising rate of 30° C./min. Arriving 200° C., the samples were left for-one minutes, then decreased at a descending rate of 10° C./min to determine an exothermic peak accompanied with crystallization. The peak temperature was designated as a crystallization temperature. The temperature was raised again at a raising rate of 10° C./min in the rage 20-120° C. and from the endothermic peak appearing between 78-100° C., the melting point of the toner was determined.

The microcrystalline wax which is a wax of petroleum origin is mainly obtained from solid residue of vacuum distillation of a crude oil. Since the microcrystalline wax contains a branched hydrocarbon (isoparaffin) and a saturated cyclic hydrocarbon (cycloparaffin), the crystalline tends to be smaller compared with the paraffin wax of the same petroleum origin. Moreover, compared with a paraffin wax, physical properties, for example, molecular weight, melting point, and melt viscosity are higher.

Examples of a microcrystalline wax usable in the present invention include: HNP-0190, HI-MIC-1045, HI-MIC-1070, HI-MIC-1074, HI-MIC-1080, HI-MIC-1090, HI-MIC-2045, HI-MIC-2065, and HI-MIC-2095 all of which are produced by Nippon Seiro, Co., Ltd.

Further preferable is the microcrystalline wax having a lower molecular weight, and the number average molecular weight of the microcrystalline wax is preferably 300-1,000 and more preferably 400-800. The Mw/Mn value of the microcrystalline wax is preferably 1.01-1.20. The reason why a low molecular weight wax exhibits a broadened re-crystallization process is not fully clear, however, it is assumed that the melting rate of a low molecular weight wax is rather fast and a small distribution in the molecular weight of the wax may cause a larger distribution in re-crystallization temperature, resulting in the broadened thermal behavior.

In the present invention, the microcrystalline wax as a broad melting point wax which exhibits a broadened re-crystallization peal (exothermic peak) while cooling, and the sharp melting point wax which exhibits a sharp endothermic peak while melting, are preferably used together.

Specific examples of a sharp melting point wax include: natural waxes, for example, carnauba wax and rice wax; polyolefine waxes, for example, polyethylene wax and polypropylene wax; hydrocarbon waxes, for example, Fischer-Tropsch wax and paraffin wax. As more preferable waxes, paraffin wax as a hydrocarbon wax and olefinolefine wax and Fischer-Tropsch wax as synthetic hydrocarbon waxes may be cited.

As ester waxes, monofunctional and multifunctional ester waxes, condensation and non-condensation waxes thereof, amide wax and ketone wax are applicable.

An electrophotographic toner of this invention can be manufactured by repeating a process, in which at least a polymer primary particle dispersion and a colorant particle dispersion are mixed in advance and inorganic metal salt is added into this dispersion while stirring to aggregate and fuse each particle resulting in preparation of mother particles, and a successive process, in which a polymer primary particle dispersion identical to or different from the aforesaid polymer primary particle dispersion was added thereto to be aggregated and fused on the mother particles to form an outer layer, at least one or two times to form capsule layers.

Polymer primary particles utilized in the electrophotographic toner of this invention include: radical polymerization resin such as (meth)acrylic ester resin; aromatic vinyl resin; and condensation polymerization resin such as polyester resin, of which average particle diameter is preferably 80-200 nm and more preferably of 100-150 nm.

Polymer primary particles may be manufactured by any wet method, and such as an emulsion polymerization method, a suspension polymerization method and an emulsion dispersion method can be applied. In the following, polymer primary particles manufactured by an emulsion polymerization method will be explained as an example; however, components and manufacturing methods of polymer primary particles utilizable in this invention are not limited thereto. As a polymerizable monomer to prepare polymer primary particles by an emulsion polymerization method, preferably utilized is at least one type of monomer selected from radical polymerizable monomers, specifically from radical polymerizable monomers having an acid group, as an essential constituent. Further, a cross-linking agent may be preferably used with a radical polymerizable monomer. As such a radical polymerizable monomer, aromatic vinyl monomer and (meth)acrylic acid ester monomer can be cited.

Examples of an aromatic vinyl monomer includes: styrene monomers such as styrene, o-methylstyrene, m-methylstyrene, p-methylstyrene, p-methoxystyrene, p-phenylstyrene, p-chlorostyrene, p-ethylstyrene, p-n-butylstyrene, p-tert-butylstyrene, p-n-hexylstyrene, p-n-octylstyrene, p-n-nonylstyrene, p-n-decylstyrene, p-n-dodecylstyrene, 2,4-dimthylstyrene and 3,4-dichlorostyrene; and derivatives thereof.

Examples of a (Meth)acrylic ester monomer includes: methyl acrylate, ethyl acrylate, butyl acrylate, 2-ethylhexyl acrylate, cyclohexyl acrylate, phenyl acrylate, methyl methacrylate, ethyl methacrylate, butyl methacrylate, hexyl methacrylate, 2-ethylhexyl methacrylate, ethyl β-hydroxyacrylate, propyl γ-aminoacrylate, stearyl methacrylate, dimethylaminoethyl methacrylate and diethylaminoethyl methacrylate.

As a cross-linking agent, a radical polymerizing cross-linking agent may be incorporated to improve characteristics of toner. Radical polymerizing cross-linking agents include those provided with at least two unsaturated bonds such as divinyl benzene, divinyl naphthalene, divinyl ether, diethylene glycol methacrylate, ethylene glycol dimethacrylate, polyethylene glycol dimethacrylate and diallyl phthalate.

In the present invention, examples of a resin having a polar group include resins having, for example, an acid group, a basic group, an ammonium salt, a pyridinium salt, or an amide group.

Examples of a radical polymerizable monomer having an acid group include: carboxylic acid-containing monomers such as acrylic acid, methacrylic acid, fumaric acid, maleic acid, itaconic acid, cinnamic acid, maleic acid monobutyl ester and maleic acid monooctyl ester; and sulfonic acid-containing monomers such as styrene sulfonic acid, allylsulfosuccinic acid and octyl allylsulfosuccinate. These monomers may be alkaline metal salts containing, for example, sodium or potassium; or alkaline earth metal salts containing, for example, calcium.

Examples of a radical polymerizable monomer having a basic group include: compounds having an amino group (a primary amino group, a secondary amino group or a tertiary amino group); and basic heterocyclic compounds, and specifically cited are, for example, dimethylaminoethyl acrylate, dimethylaminoethyl methacrylate, diethylaminoethyl acrylate, diethylaminoethyl methacrylate, 3-dimethylaminophenyl acrylate, vinylpyridine and vinylpyrrolidone.

Examples of a radical polymerizable monomer having an ammonium salt or a pyridinium salt include: quaternary ammonium salts of, for example, dimethylaminoethyl acrylate, dimethylaminoethyl methacrylate, diethylaminoethyl acrylate and diethylaminoethyl methacrylate; a 2-hydroxy-3-methacryloxy propyltrimethyl ammonium salt; N,N-diallyl methylammonium chloride; N,N-diallylethylammonium chloride; vinyl-N-methylpyridinium chloride; and vinyl-N-ethylpyridinium chloride.

Examples of a radical polymerizable monomer having an amide group include: acrylamide, N-butylacrylamide, N,N-dibutylacrylamide, piperidylacrylamide, methacrylamide, N-butylmethacrylamide, and N-octadecylacrylamide.

The radical polymerizable monomer used in the present invention preferably contains 0.1-15% by weight of radical polymerizable monomer having a polar group. The amount of the radical polymerizable cross-linking agent is preferably 0.1-10% by weight based on the total weight of the radical polymerizable monomers, although it depends on the property of the radical polymerizable cross-linking agent.

To adjust the molecular weight of a resin, a common chain transfer agent may be utilized. Chain transfer agents utilized are not specifically limited and include mercaptans such as octyl mercaptan, dodecyl mercaptan and tert-dodecyl mercaptan; and styrene dimmer.

Radical polymerization initiators utilized in the electrophotographic toner of the present invention are suitably usable provided that it is water-soluble. Listed are, for example, persulfates such potassium persulfate and ammonium persulfate; azo compounds such as 4,4'-azobis-4-cyanovalerate and salts thereof, and 2,2'-azobis(2-amidinopropane) salt; and peroxide compounds. Further, radical polymerization initiators described above may be appropriately utilized as a redox initiator in combination with a reducing agent if necessary. By utilizing a redox initiator, polymerization reactivity is increased enabling a lower polymerization temperature in addition to a shorter polymerization time.

At the time of emulsion polymerization being performed by utilizing the aforesaid radical polymerizable monomer, surfactants utilizable are not specifically limited; however, ionic and nonionic surfactants described below are suitably utilized.

Examples of ionic surfactants include: sulfonates (such as sodium dodecylbenzene sulfonate, sodium arylalkyl polyether sulfonate, sodium 3,3-disulfondiphenylurea-4,4-diazo-bis-amino-8-naphthol-6-sulfonate, ortho-carboxybenzene-azo-dimethylaniline and sodium 2,2,5,5-tetramethyl-triphenylmethane-4,4-diazo-bis-β-naphthol-6-sulfonate), sulfuric ester salts (such as sodium dodecylsulfate, sodium tetradecylsulfate, sodium pentadecylsulfate and sodium octylsulfate) and fatty acid salts (sodium oleate, sodium laurate, sodium caprate, sodium caprylate, sodium caproate, potassium stearate and calcium oleate).

Nonionic surfactants include such as polyethylene oxide, polypropylene oxide, a combination of polypropylene oxide and polyethylene oxide, ester of polyethylene glycol and higher fatty acid, alkylphenol polyethylene oxide, ester of higher fatty acid and polyethylene glycol, ester of higher fatty acid and polypropylene oxide and sorbitane ester, however, polymerization may be performed by appropriately utilizing these nonionic surfactants in combination with the aforesaid ionic surfactant.

In the present invention, a nonionic surfactant is utilized for the purpose of dispersion stabilization of each particles in an aggregation process and of adjustment of aggregation power of dispersed particles, in addition to as an emulsifying agent at the time of emulsion polymerization. That is, since nonionic surfactant significantly decreases dispersion stabilization power of particles at a temperature of not lower than the clouding point, it becomes possible to adjust aggregation power between particles based on control of the aggregation temperature to achieve uniform and efficient aggregation of particles.

As a colorant utilized in the present invention, utilized can be pigment well known in the art and conventionally utilized as a colorant for a full-color toner. For example, listed are carbon black, aniline blue, charcoyl blue, Chrome Yellow, ultramarine blue, Du Pont Oil Red, quinoline yellow, methylene blue chloride, copper phthalocyanine, malachite green oxalate, lamp black, Rose Bengal, C. I. Pigment Red 48:1, C. I. Pigment Red 122, C. I. Pigment Red 57:1, C. I. Pigment Red 184, C. I. Pigment Yellow 97, C. I. Pigment Yellow 12, C. I. Pigment Yellow 17, C. I. Solvent Yellow 162, C. I. Pigment Yellow 180, C. I. Pigment Yellow 185, C. I. Pigment Blue 15:1 and C. I. Pigment Blue 15:3.

In the present invention, a charge control agent and a magnetic powder may be incorporated in toner particles in addition to the release agent which is the above-described wax. The addition amount of a release agent is preferably 0.5-15 weight parts and-preferably 1-10 weight parts, in 100 weight parts of binder resin. When at least two waxes are utilized as a release agent, the total amount of the waxes is preferably in the above-described range.

As a charge control agent, utilized can be charge control agents which are well known in the art and conventionally utilized to control charging capability in the field of an electrostatic development toner. For example, fluorine-containing surfactants, salisylic acid metal complexes, metal containing dyes such as azo metal compounds, polymer acids such as copolymer containing maleic acid as a monomer component, quaternary ammonium salt, azine dyes such as Nigrosine, and carbon black can be utilized. A charge control agent may be utilized at a ratio of 0.01-5 weigh parts and preferably 0.05-3 weight parts, against the 100 weight parts of the total binder resin.

An example of a manufacturing method of an electrophotographic toner of the present invention includes a polymerization process to prepare a polymer primary particle dispersion by use of the aforesaid radical polymerizable monomer, a mother particle forming process to prepare mother particles by mixing a polymer primary particle dispersion and a colorant particle dispersion in a water-based medium to aggregate and fuse each particle, a capsulation process to form a capsule layer by adding a polymer primary particle dispersion in a water-based dispersion of mother particles, a filtering-washing process to eliminate such as a surfactant from said toner particles by filtering out said toner particles from the prepared dispersion of capsulated toner particles, and a drying process to dry the toner particles having been washed. In the following, the outline of each process will be explained.

In the polymerization process, liquid drops of radical polymerizable monomer solution are formed in an aqueous medium (an aqueous solution of a surfactant and a radical polymerization initiator), and an emulsion polymerization reaction is carried out in the liquid drops, which is initiated by a radical from the radical polymerization initiator existing in the aqueous medium. As a surfactant to be added in a water-based medium, anionic surfactants and nonionic surfactants can be utilized, and these are added alone or by mixing to make a suitable composition. The polymerization temperature may be selected at any temperature provided being not lower than the lowest radical generating temperature of a polymerization initiator, however, for example, it is set in a range of 50-90° C. Herein, it is possible to perform polymerization at room temperature or higher temperature by employing a polymerization initiator to initiate at ordinary temperature, for example, a combination of hydrogen peroxide and a reducing agent (such as ascorbic acid).

In a mother particle forming process, such as a colorant particle dispersion is mixed into a resin particle dispersion prepared by the aforesaid polymerization process and each particle is aggregated by salting out, further followed by being fused with heat. In said process, wax particles and inner additive particles of such as a charge control agent may be simultaneously fused.

Colorant particles can be prepared by dispersing a colorant in a water-based medium. Dispersion process of a colorant is performed under a state of setting surfactant concentration to not less than the critical micelle concentration (CMC). Utilizable surfactants include anionic surfactants and nonionic surfactants, which are utilized alone or by mixing at a suitable composition. Homogenizers utilized for a dispersion process of a colorant are not specifically limited; however, preferably include an ultrasonic homogenizer, a pressure homogenizer such as a mechanical homogenizer and a pressure type homogenizer, a medium type homogenizer such as a sand grinder and a diamond fine mill. Further, utilizable surfactants include those similar to the surfactants described before.

In a method to aggregate and fuse each particle, after adding a salting out agent, which is comprised of such as alkali metal salt and alkali earth metal salt, as a coagulant of a concentration not less than the critical aggregation concentration, into a water-based medium, in which resin particles and colorant particles are present, the system is heated to not lower than glass transition temperature Tg of the aforesaid resin particles, preferably to temperature t1 which satisfies $Tg<t1<Tg+40°$ C.

Further, in the case that a nonionic surfactant, which has clouding point t3, satisfying $Tg<t3<Tg+40°$ C. against Tg of polymer primary particles, is utilized to disperse and to improve dispersion stability of each particles, an aggregation efficiency (rate) is increased by performing aggregation at temperature t1 satisfying $t1>t3$.

Salting out agents utilized here include alkali metal salt and alkali earth metal salt, and alkali metal including univalent metal such as lithium, potassium and sodium; alkali earth metal salt including divalent metal such as magnesium, calcium, strontium and barium; as well as salt of not less than trivalent metal such as aluminum. Preferably listed are such as potassium, sodium, magnesium, calcium and barium, and those constituting salt include chloride, bromide, iodide, carbonate and sulfate.

A capsulation process is performed as follows: after adding one type of a polymer primary particle dispersion, which is identical to or different from one utilized to form mother particles, alone or by mixing into a dispersion of mother particles prepared in the aforesaid mother particle forming process, the resulting dispersion is heated to a temperature higher than Tg of this resin particles and preferably to temperature t2 satisfying $Tg<t2<Tg+40°$ C., thereby these resin particles are aggregated and fused. At that time, by appropriately repeating this operation, it is possible to form a multiple capsule layers with a little mixing of resin between capsule layers.

Further, at the time of making the added resin particles adhere on the mother particle surface, it is possible to increase the adhesion rate by further addition of a coagulant having a valence identical to or not less than that of a coagulant utilized at the time of mother particle formation. A coagulant having a larger valence includes such as a trivalent aluminum salt and tetravalent poly-aluminum chloride.

Further, in the case that a nonionic surfactant having clouding point t3, satisfying $Tg<t3<Tg+40°$ C. against Tg of polymer primary particles, is utilized to disperse and to improve dispersion stability of each particle, an aggregation efficiency (rate) is increased by performing aggregation at temperature t2 satisfying $t2>t3$.

A filtering and washing process performs a filtering treatment to filter out said toner particles from the dispersion of toner particles having been prepared in the above process, and a washing treatment to eliminate such as a surfactant and a salting out agent, which coexist with the toner particles, from the filtered toner particles. Herein, a filtration treatment method includes a centrifugal separation method, a reduced pressure filtration utilizing such a Nutsche and a filtration method utilizing such as a filter press, however, is not limited thereto.

A drying process is a process to perform drying treatment of the washing treated toner particles. A dryer utilized in this process includes such as a spray dryer, a vacuum freeze dryer and a reduced pressure dryer, and preferably utilized are such as a standing shell dryer, a shifting shell dryer, a fluidized bed dryer, a rotational dryer and a stirring dryer. The water content of dried toner particles is preferably not more than 5 weight % and more preferably not more than 2 weight %. Further, in the case of toner particles being aggregated with a weak inter-particle attractive force, said aggregates may be subjected to a crushing treatment. Herein, as a crushing treatment apparatus, mechanical crushing apparatuses such as a jet mill and a HENSCHEL MIXER can be utilized.

At the time of toner particles manufactured in the above manner being subjected to an outer addition treatment, as an outer additive utilized, inorganic particles well known in the art, which have been utilized as a fluidity adjusting agent in the field of electrostatic development toner, can be employed, and, for example, various types of carbide such as silicon carbide, boron carbide, titanium carbide, zirconium carbide, hafnium carbide, vanadium carbide, tantalum carbide, niobium carbide, tungsten carbide, chromium carbide, molybdenum carbide, calcium carbide and diamond carbon lactam; various types of nitride such as boron nitride, titanium nitride and zirconium nitride; various types of boride such as zirconium boride; various types of oxide such as titanium oxide (titania), calcium oxide, magnesium oxide, zinc oxide, copper oxide, aluminum oxide, silica and colloidal silica; various types of titanic acid compounds such as calcium titanate, magnesium titanate and strontium titanate; sulfide such as molybdenum disulfide; various types of fluoride such as magnesium fluoride and carbon fluoride; various types of metal soap such as aluminum stearate, calcium stearate, zinc stearate and magnesium stearate; and various types of non-magnetic inorganic particles such as talc and bentonite; can be utilized alone or in combination.

Inorganic particles, particularly, such as silica, titanium oxide, alumina and zinc oxide are preferably surface treated by a well known method in the art employing hydrophobicity providing agents conventionally utilized such as a silane coupling agent, a titanate type coupling agent, silicone oil and silicone vanish, and further a treating agent such as a fluorine type silane coupling agent or a fluorine type silicone oil, a coupling agent provided with an amino group or a quaternary ammonium salt group, and modified silicone oil.

The mean primary particle diameter of inorganic particles utilized as an outer additive is 5-100 nm, preferably 10-50 nm and more preferably 20-40 nm. By utilizing inorganic particles having such a particle diameter, it is possible to efficiently control adhesion stress of a toner to be in the aforesaid range.

The addition amount (G (weight %)) of an outer additive having the above-described particle diameter against toner particles is desirably an amount so as to make a product (D50×G), of a volume average particle diameter (D50 (μm)) and the addition amount, of 4-14, preferably of 5-13.5 and more preferably of 6-13. In the present invention, since the addition amount of an outer additive can be set relatively small in this manner, it is considered that charging environmental stability of toner is improved. Herein, G means the total addition amount, when at least two types of outer additives are utilized.

The present invention does not exclude further external additives, for example, "inorganic particles having a particle diameter out of the above-described range" and "organic particles" onto toner particles. The following organic particles may also be used as a cleaning aid or for other purposes, for example, styrene particles, (meth)acrylic particles, benzoguanamine particles, melamine particles, polytetrafluoroethylene particles, silicone particles, polyethylene particles and polypropylene particles, which have been made into particles by wet polymerization methods, for example, an emulsion polymerization method, a soap free emulsion polymerization method, a non-aqueous dispersion polymerization method and a gas phase method.

An electrophotographic toner of the present invention preferably has a median diameter (D50) of number particle distribution, with respect to toner particles comprising said toner, of 2-7 μm.

Herein, the median diameter of toner particles refers to the 50% point in particle diameter.

An electrophotographic toner of the present invention is preferably provided with a CV value in number particle distribution of 5-30. A CV value in number based particle distribution represents a degree of dispersion in number particle distribution of toner particles, and is defined by the following equation. The smaller a CV value is, the sharper particle distribution is; which means that the diameter of toner particles is uniform.

$$CV\ \text{value}=(\text{standard deviation in number particle distribution})/(\text{number median diameter}(D50))\times 100$$

[Measurement of Physical Properties of Toner]

(Number Median Diameter (D50) and CV Value)

Measurement of number median diameter (D50) and CV value of the toner can be carried out by using Coulter Multisizer III (produced by Beckman Coulter Inc.), connected with a computer system (produced by Beckman Coulter Inc.) for data processing. Measurement is carried out as follows: A surfactant solution is prepared, for example, by diluting a commercially available neutral detergent containing a surfactant with pure water by ten times. 20 ml of the surfactant solution is mixed with 0.02 g of toner. After making the toner blended with the surfactant solution, the mixture is subjected to an ultrasonic dispersion for one minute to obtain a toner dispersion. The toner dispersion is then poured, using a pipette, in a beaker containing ISOTON II (diluent; produced by Beckman Coulter Inc.) placed in a sample stand, until the content shown in the monitor increased to 5% by weight. The count number of particles is set at 25,000 and a 50 μm aperture is used.

An electrophotographic toner of the present invention may be utilized either as a full-color toner utilized in a full-color image forming apparatus or as a monochromatic toner utilized in a monochromatic image forming apparatus, however, is preferably utilized as a full-color toner. In a full-color image forming apparatus, generally generation of missing of an intermediate portion in the image is significant due to deterioration of transfer capability; however, it is possible to effectively prevent transfer capability from being deteriorated while keeping excellent environmental stability in chargeability of the toner by utilizing an electrophotographic toner of the present invention. In a full-color image forming apparatus, a solid image, in which toner layers of 1-4 are accumulated, is often formed, and in said solid image, since there exist regions where numbers of accumulated toner layers are different, a transfer pressure becomes higher where the number of accumulated toner layers is larger; therefore it is considered that generation of missing of an intermediate portion due to deterioration of a transfer capability becomes significant. Further, an electrophotographic toner of the present invention may be utilized in an image forming apparatus provided with any type of fixing apparatus, however, it is preferably utilized in an image forming apparatus provided with a fixing apparatus of a type, in which the amount of a release oil coated on a fixing member such as a roller is reduced, that is a fixing apparatus in which the coating amount of release oil is not more than 4 mg/m$^2$. Specifically preferably, it is utilized in a fixing apparatus in which no release oil is coated. Conventional toner utilized in an image forming apparatus provided with such a fixing apparatus generally contains a release agent to prevent generation of high temperature offset, and a release agent is liable to be exposed on the surface of particles to deteriorate transfer capability resulting in significant generation of missing of an intermediate portion, however, an electrophotographic toner of the present invention has a tendency of a release agent not being exposed on the toner particle surface, it is possible to prevent deterioration of transfer capability while keeping excellent charging environmental stability.

Therefore, an electrophotographic toner of the present invention can most effectively exhibit the effects of the present invention in the case of being utilized as a full-color toner for oil-less fixing. That is, an electrophotographic toner of the present invention can prevent deterioration of transfer capability while maintaining excellent environmental stability in chargeability, even when being utilized in a full-color image forming apparatus provided with an oil-less fixing apparatus.

An electrophotographic toner of the present invention is preferably a negatively charging toner, and can be utilized either as a two-component developer, in which the toner has been mixed with a carrier, or as a single-component developer which does not employ a carrier.

EXAMPLES

In the following, the present invention will be detailed with reference to examples; however, embodiments of the present invention are not limited thereto. Herein, "part(s)" represents "weight part(s)".

[Preparation of Latex Particles]

(Preparation of Latex Particles (1))

(1) Preparation of Core Particles (The First Step Polymerization)

(Dispersion Medium 1)

| | |
|---|---|
| Sodium dodecyl sulfate | 4.05 g |
| Ion-exchanged water | 2500.00 g |

In a 5000 ml separable flask equipped with a stirrer, a thermometer, a condenser and a nitrogen introducing device, above-described dispersion medium 1 was charged and temperature of the interior of the flask was raised to 80° C. while stirring at a rate of 230 rpm under nitrogen gas flow.

(Monomer Solution 1)

| | |
|---|---|
| Styrene | 568.00 g |
| n-Butyl acrylate | 164.00 g |
| Methacrylic acid | 68.00 g |
| n-Octyl mercaptan | 16.51 g |

Above-described dispersion medium 1 was added with an initiator solution in which 9.62 g of a polymerization initiator (potassium persulfate) was dissolved in 200 g of ion-exchanged water, above-described monomer solution 1 being dropped over 90 minutes, and the system was heated at 80° C. and stirred for 2 hours to perform polymerization (first polymerization), resulting in preparation of a latex dispersion. This dispersion was designated as "latex (1H)". A weight average particle diameter of latex (1H) was 68 nm.

(2) Formation of Intermediate Layer (The Second Step Polymerization/Mini-emulsion Polymerization)

(Monomer Solution 2)

| | |
|---|---|
| Styrene | 123.81 g |
| n-Butyl acrylate | 39.51 g |
| Methacrylic acid | 15.37 g |
| n-Octyl mercaptan | 0.72 g |
| HNP-0190 (broad melting point wax, microcrystalline wax, manufactured by Nippon Seiro Co. Ltd.) | 47.00 g |
| HNP-9 (sharp melting point wax, petroleum origin paraffin (hydrocarbon), manufactured by Nippon Seika Co. Ltd.) | 47.00 g |

In a flask equipped with a stirrer, above-described monomer solution 2 was charged and heated at 80° C. to be dissolved, whereby a monomer solution was prepared.

(Dispersion Medium 2)

| | |
|---|---|
| $C_{12}H_{25}O(OCH_2CH_2)_3SO_3Na$ | 0.60 g |
| Ion-exchanged water | 800.00 g |

Subsequently, dispersion 2 was heated to 80° C. in a 1.8 L glass container, above-described monomer solution 2 being added, and the system was mixed and dispersed by use of a mechanical homogenizer "CLEARMIX" (produced by M Technique Co., Ltd.) provided with a circulation path at 80° C. for 1 hour, whereby a dispersion (a mini-emulsion) was prepared. Next, in a 5000 ml separable flask equipped with a stirrer, a thermometer, a condenser and a nitrogen gas introducing device, an emulsion containing 140 g of latex (1H) and 1600 g of ion-exchanged water was charged, a dispersion (a mini-emulsion) containing above-described monomer solution 2 being added rapidly after dispersion, whereby a mixed solution having an liquid temperature inside of the flask of 82° C. was prepared while being stirred at a rate of 230 rpm under nitrogen gas flow.

Subsequently, this mixed solution was added with a initiator solution in which 6.12 g of a polymerization initiator (potassium persulfate) was dissolved in 250 ml of ion-exchanged water, and the system was heated at 82° C. for 1-2 hours and stirred to perform polymerization (the second step polymerization), whereby prepared was a dispersion of complex resin particles having a structure in which the surface of latex (1H) particles were coated. This dispersion was designated as "latex (1HM)". Herein, the weight average molecular weight of 1HM latex was 50,000.

(3) Formation of Outer Layer (The Third Step-Polymerization)

(Monomer Solution 3)

| | |
|---|---|
| Styrene | 343.64 g |
| n-Butyl acrylate | 85.47 g |
| n-Octyl mercaptan | 5.97 g |

In latex (1HM) prepared in the above manner, a initiator solution, in which 6.00 g of polymerization initiator (KPS) had been dissolved in 250 ml of ion-exchanged water, was added and above-described monomer solution 3 was dropped over 1 hour under a temperature condition of 82° C. After finished-dropping, the system was heated for 2 hours and stirred to perform polymerization (the third step polymerization), followed by being cooled down to 28° C., whereby prepared was a dispersion of a complex resin having a core portion containing latex (1H), an intermediate layer containing the second step polymerized resin and an outer layer containing the third step polymerized resin and the aforesaid second step polymerized resin layer containing HNP-0190 (manufactured by Nippon Seiro Co., Ltd.). The complex resin was designated as Latex Particle (1). The THF soluble portion of Latex Particle (1) showed a primary peak at a weight average molecular weight of 30,000 in a GPC measurement, and the weight average particle diameter of this resin particles was 170 nm.

(Preparation of Latex-Particle (2))

Latex Particle (2) was prepared in the same manner as preparation of Latex Particle (1) except that Fischer-Tropsh wax HNP-51 (manufactured by Nippon Seiro Co., Ltd.) was utilized instead of HNP-9.

(Preparation of Latex Particle (3))

Latex Particle (3) was prepared in the same manner as preparation of Latex Particle (1) except that ester wax WEP-6 (manufactured by Nippon Seiro Co., Ltd.) was utilized instead of HNP-9.

(Preparation of Latex Particle (4))

Latex Particle (4) was prepared in the same manner as preparation of Latex Particle (1) except that the mixing ration of HNP-0190 to HNP-9 was changed from 47.0:47.0 to 84.6:9.4.

(Preparation of Latex Particle (5))

Latex Particle (5) was prepared in the same manner as preparation of Latex Particle (1) except that the wax composition was changed from the HNP-0190 to HNP-9 ratio of 47.0:47.0 to the HNP-0190 to HNP-51 ratio of 75.2:18.8.

(Preparation of Latex Particle (6))

Latex Particle (6) was prepared in the same manner as preparation of Latex Particle (1) except that the wax composition was changed from the HNP-0190 to HNP-9 ratio of 47.0:47.0 to the HNP-0190 to WEP-6 ratio of 56.4:37.6.

(Preparation of Latex Particle (7))

Latex Particle (7) was prepared in the same manner as preparation of Latex Particle (1) except that the mixing ration of HNP-0190 to HNP-9 was changed from 47.0 47.0 to 28.2:65.8.

(Preparation of Latex Particle (8))

Latex Particle (8) was prepared in the same manner as preparation of Latex Particle (1) except that the mixing ration of HNP-0190 to HNP-9 was changed from 47.0:47.0 to 18.8:75.2.

(Preparation of Latex Particle (9))

Latex Particle (9) was prepared in the same manner as preparation of Latex Particle (1) except that a broad melting point wax Hi-Mic-1090 was used instead of HNP-0190.

(Preparation of Latex Particle (10))

Latex Particle (10) was prepared in the same manner as preparation of Latex Particle (2) except that Hi-Mic-1090 was used instead of HNP-0190.

(Preparation of Latex Particle (11))

Latex Particle (11) was prepared in the same manner as preparation of Latex Particle (3) except that Hi-Mic-1090 was used instead of HNP-0190.

(Preparation of Latex Particle (12))

Latex Particle (12) was prepared in the same manner as preparation of Latex Particle (4) except that Hi-Mic-1090 was used instead of HNP-0190.

(Preparation of Latex Particle (13))

Latex Particle (13) was prepared in the same manner as preparation of Latex Particle (5) except that Hi-Mic-1090 was used instead of HNP-0190.

(Preparation of Latex Particle (14))

Latex Particle (14) was prepared in the same manner as preparation of Latex Particle (6) except that Hi-Mic-1090 was used instead of HNP-0190.

(Preparation of Latex Particle (15))

Latex Particle (15) was prepared in the same manner as preparation of Latex Particle (7) except that Hi-Mic-1090 was used instead of HNP-0190.

(Preparation of Latex Particle (16))

Latex Particle (16) was prepared in the same manner as preparation of Latex Particle (8) except that Hi-Mic-1090 was used instead of HNP-0190.

(Preparation of Latex Particle (17))

Latex Particle (17) was prepared in the same manner as preparation of Latex Particle (1) except that that the mixing ration of HNP-0190 to HNP-9 was changed from 47.0:47.0 to 9.4:84.6.

(Preparation of Latex Particle (18))

Latex Particle (18) was prepared in the same manner as preparation of Latex Particle (1) except that the wax composition was changed from the HNP-0190 to HNP-9 ratio of 47.0:47.0 to the HNP-0190 to HNP-51 ratio of 9.4:84.6.

(Preparation of Latex Particle (19))

Latex Particle (19) was prepared in the same manner as preparation of Latex Particle (1) except that the wax composition was changed from the HNP-0190 to HNP-9 ratio of 47.0:47.0 to the HNP-0190 to WEP-6 ratio of 9.4:84.6.

(Preparation of Latex Particle (20))

Latex Particle (20) was prepared in the same manner as preparation of Latex Particle (1) except that that the mixing ration of HNP-0190 to HNP-9 was changed from 47.0:47.0 to 94.0:0.

(Preparation of Latex Particle (21))

Latex Particle (21) was prepared in the same manner as preparation of Latex Particle (20) except that that Hi-Mic-1090 was used instead of HNP-0190.

(Preparation of Latex Particle (22))

Latex Particle (22) was prepared in the same manner as preparation of Latex Particle (1) except that the wax composition was changed from the HNP-0190 to HNP-9 ratio of 47.0:47.0 to the HNP-0190 to WEP-6 ratio of 0:94.0.

(Preparation of Latex Particle (23))

Latex Particle (23) was prepared in the same manner as preparation of Latex Particle (1) except that the mixing ration of HNP-0190 to HNP-9 was changed-from 47.0:47.0 to 0:94.0.

(Preparation of Latex Particle (24))

Latex Particle (24) was prepared in the same manner as preparation of Latex Particle (1) except that the wax composition was changed from the HNP-0190 to HNP-9 ratio of 47.0:47.0 to the HNP-0190 to HNP-51 ratio of 0:94.0.

With respect to the broad melting point waxes HNP-0190 and Hi-Mic-1090; and the sharp melting point waxes HNP-9, HNP-51 and WEP-6, summarized in Table 1 are the results on the measurements of the following: endothermic peak (melting point), exothermic peak (crystallization temperature), peak width at half height of the endothermic peak (endothermic half-value width), peak width at half height of the exothermic peak (exothermic half-value width), peak width at 1/10 height of the endothermic peak (endothermic 1/10-value width) and peak width at 1/10 height of the exothermic peak (exothermic 1/10-value width).

TABLE 1

| Wax No. | Melting point/° C. | Crystallization Temperature/° C. | Endothermic half-value width/° C. | Endothermic 1/10-value width/° C. | Exothermic half-value width/° C. | Exothermic 1/10-value width/° C. |
|---|---|---|---|---|---|---|
| HNP-0190 | 80.2 | 78.3 | 13.0 | 23.5 | 14.5 | 22.3 |
| Hi-Mic-1090 | 80 | 76.9 | 14 | 24.5 | 15.5 | 23 |
| HNP-9 | 75.5 | 70.2 | 3 | 10 | 3 | 10 |
| HNP-51 | 76.6 | 72.5 | 3 | 8 | 4 | 10 |
| WEP-6 | 76.8 | 56.7 | 2.5 | 6 | 3 | 5 |

[Thermal Behaviors of Wax]

(Melting Point, Crystallization Temperature)

A differential scanning calorimeter (DSC-200, produced by Seiko Instruments Inc.) was used to determine the melting point and the crystallization temperature of a toner. In each measurement, 10 mg of a sample to be measured was precisely weighed and charged into an aluminum pan, also alumina was charged in another aluminum pan and used as a reference. The temperature was to 200° C. at a raising rate of 30° C./min, then decreased at a descending rate of 10° C./min to determine an exothermic peak accompanied with crystallization. The peak temperature was designated as a crystallization temperature. The temperature was raised again at a raising rate of 10° C./min in the rage 20-120° C. and from the endothermic peak appearing between 78-100° C., the melting point of the toner was determined.

(Peak Width at Half Height, Peak Width at 1/10 Height)

In the present invention, as shown in FIG. 1, a temperature region exhibiting peak intensity more than ½ height or 1/10 height of the endothermic peak or an exothermic peak was evaluated.

The peak width at half height of the endothermic or exothermic peak was obtained as follows:

(i) obtaining a intersection point of a vertical line in the DSC chart as shown in FIG. 1 including the peak point in the (endothermic or exothermic) peak profile and a tangential line of the base line;

(ii) obtaining the ½ height point in the line drawn between the peak point and the intersection point described in (i);

(iii) drawing a line parallel to the tangential line of the base line including the ½ height point described in (ii);

(iv) obtaining two intersection points of the line parallel to the tangential line of the base line described in (iii) and the peak profile curves in the higher temperature side and the lower temperature side;

(v) the peak width at half height of a peak is the temperature difference between the two temperatures corresponding to the two intersection points described in (iv).

The peak width at 1/10 height of a peak was determined in the same manner as above except that a line parallel to the tangential line of the base line was drawn including the 1/10 height point from the tangential line of the base line.

[Preparation of Pigment Particle]

(Preparation of Pigment Particle Dispersion (1))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of blue pigment (C. I. Pigment Blue 15:3) while being stirred, and subsequently subjected to a dispersion treatment by use of "CLEARMIX" (produced by M Technique Co., Ltd.), whereby a dispersion of colorant particles was prepared. The particle diameter of the dispersed blue pigment was measured by use of an Electrophretic Light Scattering Spectrophotometer, ELS-800 (produced by Otsuka Electronics Co., Ltd.). The average particle diameter was determined to be 112 nm. This pigment dispersion was designated as Pigment Particle Dispersion (1).

(Preparation-of Pigment Particle Dispersion (2))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of red pigment (C. I. Pigment Red 122) while being stirred, and subsequently subjected to a dispersion treatment by use of "CLEARMIX" (produced by M Technique Co. Ltd.), whereby a dispersion of red colorant particles was prepared. The particle diameter of the dispersed red pigment was measured by use of an Electrophretic Light Scattering Spectrophotometer, ELS-800 (produced by Otsuka Electronics Co., Ltd.). The average particle diameter was determined to be 89 nm. This pigment dispersion was designated as Pigment Particle Dispersion (2).

(Preparation of Pigment Particle Dispersion (3))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of yellow pigment (C. I. Pigment Yellow 74) while being stirred, and subsequently subjected to a dispersion treatment by use of "CLEARMIX" (produced by M Technique Co., Ltd.), whereby a dispersion of yellow colorant particles was prepared. The particle diameter of the dispersed yellow pigment was measured by use of an Electrophretic Light Scattering Spectrophotometer, ELS-800 (produced by Otsuka Electronics Co., Ltd.). The average particle diameter was determined to be 93 nm. This pigment dispersion was designated as Pigment Particle Dispersion (3).

(Preparation of Pigment Particle Dispersion (4))

In 1600 ml of ion-exchanged water, 59 g of $C_{12}H_{25}O(OCH_2CH_2)_3SO_3Na$ as an anionic surfactant were dissolved while stirring. This solution was gradually added with 420 g of black pigment (carbon black) while being stirred, and subsequently subjected to a dispersion treatment by use of "CLEARMIX" (produced by M Technique Co. Ltd.), whereby a dispersion of black colorant particles was prepared. The particle diameter of the dispersed black pigment was measured by use of an Electrophretic Light Scattering Spectrophotometer, ELS-800 (produced by Otsuka Electronics Co., Ltd.). The average particle diameter was determined to be 95 nm. This pigment dispersion was designated as Pigment Particle Dispersion (4).

[Preparation of Wax Particles]

(Preparation of Wax Dispersion (1))

In 1600 ml of ion-exchanged water, 59 g of $C_{12}H_{25}O(OCH_2CH_2)_3SO_3Na$ as an anionic surfactant were dissolved while stirring. This solution was heated at 85° C. and gradually added with 200 g of HNP-0190 (manufactured by Nippon Seiro Co., Ltd.) to dissolve the wax. Subsequently, the system was-dispersed by use of "CLEARMIX" (produced by M Technique Co., Ltd.), whereby a dispersion of wax particles was prepared. The particle diameter of the dispersed wax was measured by use of an Electrophretic Light Scattering Spectrophotometer, ELS-800 (produced by Otsuka Electronics Co., Ltd.). The average particle diameter was determined to be 120 nm. This wax dispersion was designated as Wax Dispersion (1).

EXAMPLE 1

[Preparation of Cyan Toner 1]

<Preparation of Colored Particle (1)>

A mixed solution of 200.0 g (converted solid content) of Latex Particle (1) and 5 g (converted solid content) of Pigment Particle Dispersion (1), and 900 g of ion-exchanged water were charged in a reaction vessel (a four-necked flask) equipped with a thermometer, a condenser, a nitrogen introducing device and a stirrer, and the mixture was stirred. After the temperature of the inside of the vessel was adjusted to 30° C., this solution was added with a 2M sodium hydroxide aqueous solution to adjust the pH to 8-10.0.

Subsequently, the resulting solution was added with an aqueous solution, in which 65.0 g of magnesium chloride·6 hydrate was dissolved in 1000 ml of ion-exchanged water, over 10 minutes while stirring at 30° C. After standing for 3 minutes, the system was heated to 92° C. to perform-formation of associated particles. In that state, the particle diameter of associated particles was measured by use of Coulter Counter: TA-II produced by Beckman Coulter Inc. and particle growth was stopped by addition of an aqueous solution in which 80.4 g of sodium chloride was dissolved in 1000 ml of ion-exchanged water, when the number average particle diameter reached 4.5 μm. Then, as a ripening process, fusion of particles and phase separation of crystalline substances were continued by heating and stirring the system at a liquid temperature of 94° C. In that state, the shape of associated particles was measured by use of FPIA-2000 produced by Sysmex Corp. and the system was cooled down to 30° C. and stirring was stopped when the shape factor reached 0.965. The formed associated particles were filtered, repeatedly washed with ion-exchanged water at 45° C., followed by being dried with a hot wind of 40° C., whereby colored particles (1) was prepared. The number based median diameter was measured again and it was found to be 4.5 μm.

<External Addition Treatment>

Into the above prepared colored particles, hydrophobic silica (number average primary particle diameter=12 nm, hydrophobicity=68) was added to a ratio of 1.0 weight % as well as hydrophobic titanium oxide (number average primary particle diameter=20 nm, hydrophobicity=63) was added to a ratio of 1.2 weight %, and the system was mixed by a HENSCHEL MIXER to manufacture Cyan Toner 1. Herein, with respect to the colored particles, the shape and particle diameter were not changed by addition of hydrophobic silica and hydrophobic titanium oxide.

EXAMPLE 2

[Preparation of Cyan Toner 2]

<Preparation of Colored Particles (2)>

The above-described latex (1H) of 240 parts, 13.6 parts of Wax Dispersion (1), 24 parts of Colored Particle Dispersion (1), 5 parts of an anionic surfactant (Neogen SC, manufactured by Daiichi Yakuhin Kogyo Co., Ltd.) and 240 parts of ion-exchanged water were charged in a reaction vessel equipped with a stirrer, a condenser and a thermometer, and the mixture was added with a 2M sodium hydroxide aqueous solution while being stirred to adjust the pH to 10.0. Subsequently, after adding 40 parts of a 50 weight % magnesium chloride aqueous solution thereto, the system was heated to 56° C. while being stirred and was kept standing for 1.0 hour. The mean particle diameter of toner in the mixed dispersion was 4.3 μm. Next, after the temperature inside of the system was cooled down to 75° C., 30 parts of latex (1H) being added, and then the system was heated to 94° C., 120 g of a 20 weight % sodium chloride aqueous solution being added, and kept standing for 6 hours. In that state, the shape of associated particles was measured by use of "FPIA-2000". The system was cooled down to 30° C. when the shape factor reached 0.965 and stirring was stopped. The formed associated particles were filtered, repeatedly washed with ion-exchanged water of 45° C., followed by being dried with a hot wind of 40° C., whereby Colored Particles (2) was prepared. The number based median diameter was measured again and found to be 4.8 μm. Further, it has been confirmed that the toner surface is smooth and there is not exposed on the surface of pigment, by observation of the toner after drying through SEM.

<External Addition Treatment>

Cyan Toner 2 was manufactured by performing an external addition treatment in the same manner as Example 1.

EXAMPLE 3

Magenta Toner 3 was prepared in the same manner as Example 1 except that Pigment Particle Dispersion (2) was used instead of Pigment Particle Dispersion (1).

EXAMPLE 4

Yellow Toner 4 was prepared in the same manner as Example 1 except that Pigment Particle Dispersion (3) was used instead of Pigment Particle Dispersion (1).

EXAMPLE 5

Black Toner 5 was prepared in the same manner as Example 1 except that Pigment Particle Dispersion (4) was used instead of Pigment Particle Dispersion (1).

EXAMPLE 6

Cyan Toner 6 was prepared in the same manner as Example 1 except that Latex Particle (2) was used instead of Latex Particle (1).

EXAMPLE 7

Cyan Toner 7 was prepared in the same manner as Example 1 except that Latex Particle (3) was used instead of Latex Particle (1).

EXAMPLE 8

Cyan Toner 8 was prepared-in the same manner as Example 1 except that Latex Particle (4) was used instead of Latex Particle (1).

EXAMPLE 9

Cyan Toner 9 was prepared in the same manner as Example 1 except that Latex Particle (5) was used instead of Latex Particle (1).

EXAMPLE 10

Cyan Toner 10 was prepared in the same manner as Example 1 except that Latex Particle (6) was used instead of Latex Particle (1).

EXAMPLE 11

Cyan Toner 11 was prepared in the same manner as Example 1 except that Latex Particle (7) was used instead of Latex Particle (1).

EXAMPLE 12

Cyan Toner 12 was prepared in the same manner as Example 1 except that Latex Particle (8) was used instead of Latex Particle (1).

EXAMPLE 13

Cyan Toner 13 was prepared in the same manner as Example 1 except that Latex Particle (9) was used instead of Latex Particle (1).

EXAMPLE 14

Cyan Toner 14 was prepared in the same manner as Example 1 except that Latex Particle (10) was used instead of Latex Particle (1).

EXAMPLE 15

Cyan Toner 15 was prepared in the same manner as Example 1 except that Latex Particle (11) was used instead of Latex Particle (1).

EXAMPLE 16

Cyan Toner 16 was prepared in the same manner as Example 1 except that Latex Particle (12) was used instead of Latex Particle (1).

EXAMPLE 17

Cyan Toner 17 was prepared in the same manner as Example 1 except that Latex Particle (13) was used instead of Latex Particle (1).

EXAMPLE 18

Cyan Toner 18 was prepared in the same manner as Example 1 except that Latex Particle (14) was used instead of Latex Particle (1).

EXAMPLE 19

Cyan Toner 19 was prepared in the same manner as Example 1 except that Latex Particle (15) was used instead of Latex Particle (1).

EXAMPLE 20

Cyan Toner 20 was prepared in the same manner as Example 1 except that Latex Particle (16) was used instead of Latex Particle (1).

COMPARATIVE EXAMPLE 1

Cyan Toner 21 was prepared in the same manner as Example 1 except that Latex Particle (17) was used instead of Latex Particle (1).

COMPARATIVE EXAMPLE 2

Cyan Toner 22 was prepared in the same manner as Example 1 except that Latex Particle (18) was used instead of Latex Particle (1).

COMPARATIVE EXAMPLE 3

Cyan Toner 23 was prepared in the same manner as Example 1 except that Latex Particle (19) was used instead of Latex Particle (1).

COMPARATIVE EXAMPLE 4

Cyan Toner 24 was prepared in the same manner as Example 1 except that Latex Particle (20) was used instead of Latex Particle (1).

COMPARATIVE EXAMPLE 5

Cyan Toner 25 was prepared in the same manner as Example 1 except that Latex Particle (21) was used instead of Latex Particle (1).

COMPARATIVE EXAMPLE 6

Cyan Toner 26 was prepared in the same manner as Example 1 except that Latex Particle (22) was used instead of Latex Particle (1).

COMPARATIVE EXAMPLE 7

Cyan Toner 27 was prepared in the same manner as Example 1 except that Latex Particle (23) was used instead of Latex Particle (1).

COMPARATIVE EXAMPLE 8

Cyan Toner 28 was prepared in the same manner as. Example 1 except that Latex Particle (24) was used instead of Latex Particle (1).

[Measurement of Physical Properties of Toner]

(Number Median Diameter (D50))

Measurement of number median diameter (D50) of the electrophotographic toner of the present invention was carried out by using Coulter Multisizer III (produced by Beckman Coulter Inc.), connected with a computer system (produced by Beckman Coulter Inc.) for data processing. Measurement was carried out as follows: A surfactant solution was prepared, for example, by diluting a commercially available neutral detergent containing a surfactant with pure water by ten times. 20 ml of the surfactant solution was mixed with 0.02 g of toner. After making the toner blended with the surfactant solution, the mixture was subjected to an ultrasonic dispersion for one minute to obtain a toner dispersion. The toner dispersion was then poured, using a pipette, in a beaker containing ISOTON II (diluent; produced by Beckman Coulter Inc.) placed in a sample stand, until the content shown in the monitor increased to 5% by weight. Reproducible results were obtained at this toner content. The count number of particles was set at 25,000 and a 50 μm aperture was used.

(Molecular Weight)

Molecular weight was measured by use of a gel permeation chromatography (807-IT: produced by JASCO Inc.). Tetrahydrofuran as a carrier solvent was flown at 1 kg/cm$^2$ while keeping the column temperature at 40° C. 30 mg of a sample was dissolved in 20 ml of tetrahydrofuran and 0.5 mg of the solution was introduced into the apparatus together with the above carrier solvent to determine the molecular weight with polystyrene standard.

TABLE 2

| | Particle diameter/μm | CV | Molecular weight |
|---|---|---|---|
| Example 1 | 4.5 | 20 | 30,000 |
| Example 2 | 4.8 | 24 | 31,000 |
| Example 3 | 4.6 | 21 | 30,000 |
| Example 4 | 4.7 | 20 | 30,000 |
| Example 5 | 4.8 | 25 | 32,000 |
| Example 6 | 4.6 | 21 | 30,000 |
| Example 7 | 4.5 | 20 | 30,000 |
| Example 8 | 4.5 | 20 | 30,000 |
| Example 9 | 4.6 | 21 | 30,000 |
| Example 10 | 4.7 | 20 | 30,000 |
| Example 11 | 4.6 | 20 | 31,000 |
| Example 12 | 4.7 | 21 | 30,000 |
| Example 13 | 4.5 | 20 | 30,000 |
| Example 14 | 4.6 | 21 | 30,000 |
| Example 15 | 4.5 | 20 | 30,000 |
| Example 16 | 4.5 | 20 | 30,000 |
| Example 17 | 4.6 | 21 | 30,000 |
| Example 18 | 4.7 | 20 | 30,000 |
| Example 19 | 4.6 | 20 | 31,000 |
| Example 20 | 4.7 | 21 | 30,000 |
| Comparative Example 1 | 4.4 | 21 | 29,500 |

TABLE 2-continued

| | Particle diameter/μm | CV | Molecular weight |
|---|---|---|---|
| Comparative Example 2 | 4.6 | 22 | 30,000 |
| Comparative Example 3 | 4.8 | 20 | 32,000 |
| Comparative Example 4 | 4.7 | 20 | 30,000 |
| Comparative Example 5 | 4.7 | 20 | 30,000 |
| Comparative Example 6 | 4.5 | 20 | 30,000 |
| Comparative Example 7 | 4.6 | 21 | 30,000 |
| Comparative Example 8 | 4.7 | 20 | 30,000 |

[Preparation of Developer]

To evaluate toner prepared in the above-described examples and comparative examples as a two-component developer, the toner was mixed with a ferrite carrier, which was covered with silicone resin and had a volume average particle diameter of 50 μm, whereby a developer having a toner concentration of 6% was prepared.

[Evaluation of Toner]

(High Temperature Storage Stability)

10 g of each toner was stored at 50° C. for 24 hours, and visually evaluated.

A: No aggregated particle was observed.

B: Less than ten aggregated particles were observed.

C: Ten or more aggregated particles were observed.

In the following evaluation, above described particles were utilized.

(Peeling Resistance)

Solid images of 1.5 cm×1.5 cm (toner amount of 2.0 mg/cm$^2$) were formed by use of a digital copier (Sitios 9331; produced by Konicaminolta Business Technologies Inc.) equipped with an oil-less fixing device. The fixing temperature was varied at 2° C. intervals between 120-170° C. Each image was folded into two at the center to visually evaluate the peeling resistance of the image. The temperature between the highest fixing temperature at which the image was slightly peeled off, and the lowest fixing temperature at which the image was not peeled off was designated as a lowest fixing temperature.

A: The lowest fixing temperature was lower than 142° C.

B: The lowest fixing temperature was 142° C. or more but lower than 146° C.

C: The lowest fixing temperature was 146° C. or more but lower than 152° C. (suitable for practical use).

D: The lowest fixing temperature was 152° C. or more (not suitable for practical use).

(Releasability (Anti-Offset Property))

Halftone images were formed while varying the fixing temperature at 5° C. intervals between 130-190° C. by use of a digital copier (Sitios 9331; produced by Konicaminolta Business Technologies Inc.) with a fixing speed of half of the ordinary fixing speed. The occurrence of offset was visually observed to evaluate the lowest temperature at which high temperature offset was observed.

A: Offset temperature was 168° C. or more.

B: Offset temperature was 160° C. or more but lower than 168° C.

C: Offset temperature was 155° C. or more but lower than 160° C. (suitable for practical use).

D: Offset temperature was lower than 155° C. (not suitable for practical use).

(Environmental Stability of Electrostatic Chargeability (Environmental Resistance of Electrostatic Chargeability))

Evaluated was the difference between an electrostatic charge stored in a developer kept under a low temperature, low humidity condition (10° C., 15%) for 24 hours and an electrostatic charge stored in a developer under a high temperature, high humidity condition (30° C., 85%) for 24 hours.

A: The absolute value of difference in the electrostatic charge was less than 7 μC/g.

B: The absolute value of difference in the electrostatic charge was 7 μC/g or more but-less than 8 μC/g.

C: The absolute value of difference in the electrostatic charge 8 μC/g or more.

(Unevenness of Image (Glossiness))

Unevenness of the image was visually observed for the solid images (toner amount of 2.0 mg/cm$^2$) which were formed by use of a digital copier (Sitios 9331; produced by Konicaminolta Business Technologies Inc.).

A: No unevenness in the image was observed.

B: Almost no unevenness in the image was observed.

C: Unevenness in the image was observed.

D: Unevenness in the image was notably observed (not suitable for practical use).

TABLE 3

| | High Temperature Storage Stability | Peeling Resistance | Releasability (Anti-Offset Property) | Environmental Stability of Electrostatic Chargeability | Unevenness of Image (Glossiness) |
|---|---|---|---|---|---|
| Example 1 | A | B | B | A | A |
| Example 2 | A | B | B | A | A |
| Example 3 | A | B | B | A | B |
| Example 4 | A | B | B | A | B |
| Example 5 | A | B | B | A | A |
| Example 6 | A | B | B | A | B |
| Example 7 | A | B | B | A | B |
| Example 8 | A | B | B | A | A |
| Example 9 | A | B | B | A | B |
| Example 10 | A | B | B | A | B |
| Example 11 | A | B | B | A | B |
| Example 12 | A | B | B | A | B |
| Example 13 | A | B | B | A | A |
| Example 14 | A | B | B | A | B |
| Example 15 | A | B | B | A | B |
| Example 16 | A | B | B | A | A |
| Example 17 | A | B | B | A | B |
| Example 18 | A | B | B | A | B |
| Example 19 | A | B | B | A | B |
| Example 20 | A | B | B | A | B |
| Comparative example 1 | A | B | B | B-C | C-D |
| Comparative example 2 | A | B | B | B-C | C-D |
| Comparative example 3 | B | B | C | C | D |
| Comparative example 4 | A | C | C | C | D |
| Comparative example 5 | A | C | C | C | D |
| Comparative example 7 | B | B | C | C | D |
| Comparative example 8 | A | A | B | B-C | C-D |
| Comparative example 9 | A | A | B | B-C | C-D |

It is clear from table 3 that Examples 1-20, which are electrophotographic toners of the present invention, are superior to Comparative Examples 1-8 with respect to high temperature storage stability, peeling resistance, releasability (anti-offset property), environmental stability of electrostatic chargeability and unevenness of image. Specifically, with respect to environmental stability of electrostatic chargeability and unevenness of image, the superiority of the electrophotographic toners of the present invention is remarkable.

Finally, the digital copier (Sitios 9331; produced by Konicaminolta Business Technologies Inc.) was modified so that oil was used in the fixing process, and evaluation for the fixing properties using the same toners as the above examples 1-20 and comparative examples 1-8. As the results, no notable differences were observed between the toners of Examples 1-20 and the toners of Comparative Examples 1-8. These results shows that, even when oil is not used in the fixing process, the toners of Examples 1-20 of the present invention exhibit excellent releasability of images similar to the releasability obtained when oil is used in the fixing process, as well as exhibiting excellent electrostatic chargeability and high image quality.

What is claimed is:

1. An electrophotographic toner comprising a resin, a colorant and a release agent which comprises a first wax and a second wax, wherein:

(i) the first wax exhibits: an endothermic peak appearing in the range 75-100° C., a peak width at half height of the endothermic peak of 10-40° C., an exothermic peak appearing in the range 70-100° C. and a peak width at half height of the exothermic peak of 10-40° C., in a DSC measurement;

(ii) the second wax exhibits: an endothermic peak appearing in the range 60-90° C., a peak width at half height of the endothermic peak of 5° C. or less, an exothermic peak appearing in the range 55-80° C. and a peak width at half height of the exothermic peak of 5° C. or less, in the DSC measurement;

(iii) a weight ratio of the first wax to the second wax is between 9:1 and 2:8; and (iv) the resin contains a polar group.

2. The electrophotographic toner of claim 1, wherein the peak width at half height of the endothermic peak of the second wax is 3-5° C.; and the peak width at half height of the exothermic peak of the second wax is 3-5° C.

3. The electrophotographic toner of claim 1, wherein the first wax exhibits: a peak width at 1/10 height of the endothermic peak of 20-50° C. and a peak width at 1/10 height of the exothermic peak of 20-50° C.; and the second wax exhibits: a peak width at 1/10 height of the endothermic peak of 10° C. or less and a peak width at 1/10 height of the exothermic peak of 10° C. or less.

4. The electrophotographic toner of claim 3, wherein the peak width at 1/10 height of the endothermic peak of the second wax is 5-10° C.; and the peak width at 1/10 height of the exothermic peak of the second wax is 5-10° C.

5. The electrophotographic toner of claim 3, wherein a number average molecular weight of the first wax is in the range of 300-1000; and a number average molecular weight of the second wax is in the range of 300-1500.

6. The electrophotographic toner of claim 3, wherein the first wax comprises a microcrystalline wax; and the second wax comprises a hydrocarbon wax or an ester wax.

7. The electrophotographic toner of claim 6, wherein a median diameter of number particle distribution of electrophotographic toner particles is 2-7 μm; and a CV value of number diameter distribution of the electrophotographic toner particles is 5-30.

8. The electrophotographic toner of claim 6, wherein a number average molecular weight of the microcrystalline wax is in the range of 400-800; and an Mw/Mn value of the microcrystalline wax is in the range of 1.01-1.2, provided that Mw represents a weight average molecular weight and Mn represents a number average molecular weight.

9. The electrophotographic toner of claim 8, wherein the polar group comprises a carboxyl group or a sulfonic group.

10. The electrophotographic toner of claim 1, wherein the first wax comprises a microcrystalline wax; and the second wax comprises a hydrocarbon wax or an ester wax.

11. The electrophotographic toner of claim 1, wherein the resin having a polar group comprises an acid group, basic group, an ammonium salt, pyridinium salt or an amido group.

12. The electrophotographic toner of claim 9, wherein the acid group comprises a carboxyl group or a sulfonic group, and the basic group comprises an amino group.

13. The electrophotographic toner of claim 1, wherein the resin is obtained by polymerizing one or more kinds of polymerizable monomers;

at least one of the polymerizable monomers is a radical polymerizable monomer having a polar group; and a weight content of the radical polymerizable monomer having a polar group is in the range 0.1-15% based on a total weight of monomers.

14. The electrophotographic toner of claim 1, wherein a median diameter of number particle distribution of electrophotographic toner particles is 2-7 μm; and a CV value of number diameter distribution of the electrophotographic toner particles is 5-30.

15. The electrophotographic toner of claim 1, wherein a number average molecular weight of the first wax is in the range of 300-1000; and a number average molecular weight of the second wax is in the range of 300-1500.

16. The electrophotographic toner of claim 1 further comprising an external additive.

17. The electrophotographic toner of claim 1, wherein the toner comprises a plurality of toner particles and the toner particles has one or more domains in the particles, in which the domain includes the release agent.

* * * * *